US005441031A

United States Patent [19]

Kiyomiya et al.

[11] Patent Number: 5,441,031

[45] Date of Patent: Aug. 15, 1995

[54] EVAPORATIVE FUEL PROCESSING SYSTEM FOR INTERNAL COMBUSTION ENGINE

[75] Inventors: Takashi Kiyomiya; Takeshi Suzuki; Hideo Watanabe; Shoji Takahashi; Kazumi Yamazaki; Masashi Takezawa; Shigeki Baba; Kenichi Sawada; Shouji Sekiai; Hideki Kaseyama; Hiroshi Kitagawa, all of Wako, Japan

[73] Assignee: Honda Giken Kogyo Kabushiki Kaisha, Tokyo, Japan

[21] Appl. No.: 63,573

[22] Filed: May 19, 1993

[30] Foreign Application Priority Data

May 20, 1992 [JP] Japan ..... 4-151214
Dec. 16, 1992 [JP] Japan ..... 4-354585
Apr. 5, 1993 [JP] Japan ..... 5-102004

[51] Int. Cl.[6] ..... F02D 41/22

[52] U.S. Cl. ..... 123/518; 123/520; 137/202

[58] Field of Search ..... 123/516, 518, 519, 520; 137/489, 492.5, 587, 199, 202

[56] References Cited

U.S. PATENT DOCUMENTS 3,910,302 10/1975 Sudhiv ..... 137/202
4,343,281 8/1982 Uozumi et al. ..... 123/520
4,991,615 2/1991 Szlaga et al. ..... 137/202
5,012,838 5/1991 Kawase et al. ..... 137/202
5,027,780 7/1991 Uranishi et al. ..... 123/516
5,054,508 10/1991 Benjey ..... 137/587
5,097,858 3/1992 Zlokovitz et al. ..... 137/492.5
5,099,880 3/1992 Szlaga et al. ..... 137/587
5,156,178 10/1992 Harris ..... 137/587
5,174,265 12/1992 Sekine ..... 123/520
5,190,014 3/1993 Suga et al. ..... 123/516
5,193,511 3/1993 Fujino ..... 123/516
5,211,151 5/1993 Nakajima et al. ..... 123/516
5,215,132 6/1993 Kobayashi ..... 137/587
5,220,898 6/1993 Kidokoro et al. ..... 123/520
5,235,955 8/1993 Osaki ..... 123/520
5,237,979 8/1993 Hyodo et al. ..... 123/516
5,259,355 11/1993 Nakashima et al. ..... 123/520
5,261,439 11/1993 Harris ..... 123/516
5,335,638 8/1994 Mukai ..... 123/516
5,359,978 11/1994 Kidokoro et al. ..... 123/516

FOREIGN PATENT DOCUMENTS 63-41244 2/1988 Japan .
3-222855 10/1991 Japan .

*Primary Examiner*—Thomas N. Moulis
*Attorney, Agent, or Firm*—Nikaido, Marmelstein, Murray & Oram

[57] ABSTRACT

A vent passage communicated to an upper space of a fuel tank mounted on an automobile is connected to a canister. A two-way valve, which includes a pair of one-way valves disposed oppositely and in parallel to each other, is provided in the vent passage. One one-way valve is adjusted its valve opening pressure in a two-staged manner according to the operational state of an internal combustion engine. In another method, a bypass passage bypassing the two-way valve is provided in the vent passage. A solenoid valve and a one-way valve are interposed in the bypass passage. The above one one-way valve of the two-way valve is set at a first valve opening set-up pressure, and the other one-way valve is set at a second valve opening set-up pressure lower than the first valve opening set-up pressure. The solenoid valve is opened or closed according to the operational state of the internal combustion engine.

10 Claims, 11 Drawing Sheets

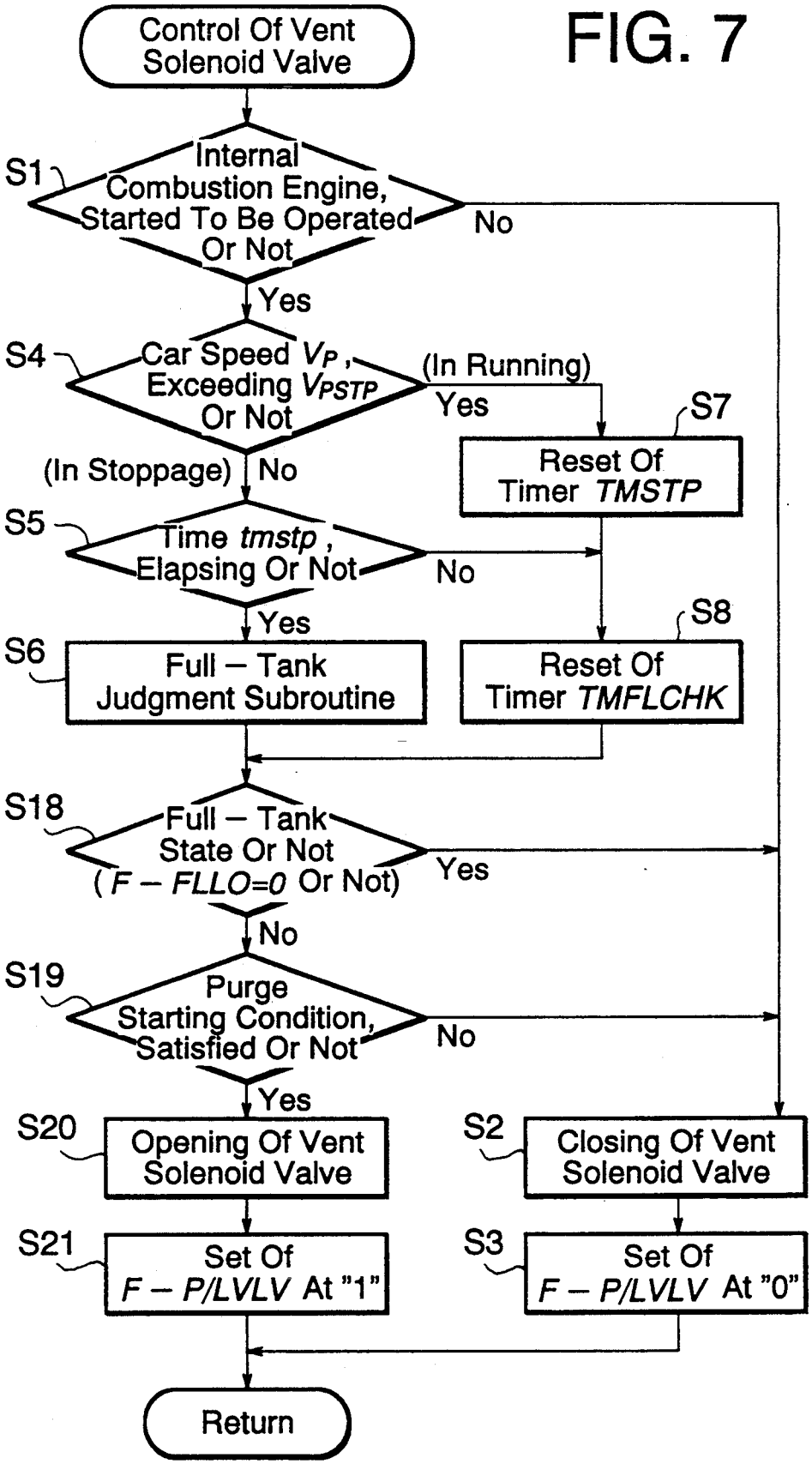
FIG. 7
Control Of Vent Solenoid Valve
S1
Internal Combustion Engine, Started To Be Operated Or Not
No
Yes
S4
Car Speed $V_P$, Exceeding $V_{PSTP}$ Or Not
(In Running)
Yes
S7
Reset Of Timer TMSTP
(In Stoppage)
No
S5
Time tmstp, Elapsing Or Not
No
Yes
S8
S6
Full – Tank Judgment Subroutine
Reset Of Timer TMFLCHK
S18
Full – Tank State Or Not (F – FLLO=0 Or Not)
Yes
No
S19
Purge Starting Condition, Satisfied Or Not
No
Yes
S20
Opening Of Vent Solenoid Valve
S2
Closing Of Vent Solenoid Valve
S21
Set Of F – P/LVLV At "1"
S3
Set Of F – P/LVLV At "0"
Return

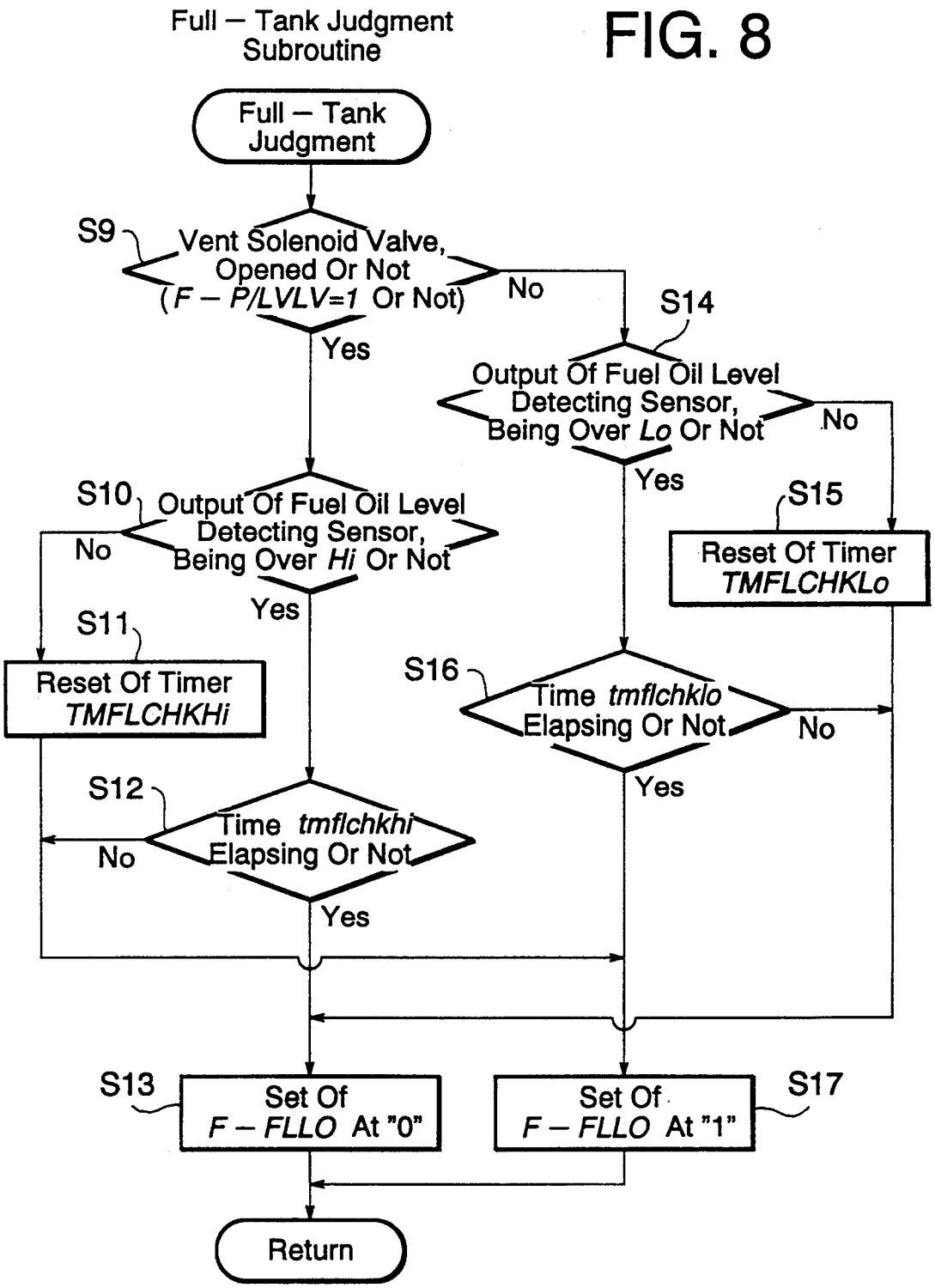
Full – Tank Judgment Subroutine
FIG. 8
Full – Tank Judgment
S9
Vent Solenoid Valve, Opened Or Not (F – P/LVLV=1 Or Not)
No
Yes
S14
Output Of Fuel Oil Level Detecting Sensor, Being Over Lo Or Not
No
Yes
S10
Output Of Fuel Oil Level Detecting Sensor, Being Over Hi Or Not
No
Yes
S15
Reset Of Timer TMFLCHKLo
S11
Reset Of Timer TMFLCHKHi
S16
Time tmflchklo Elapsing Or Not
No
Yes
S12
Time tmflchkhi Elapsing Or Not
No
Yes
S13
Set Of F – FLLO At "0"
Set Of F – FLLO At "1"
S17
Return

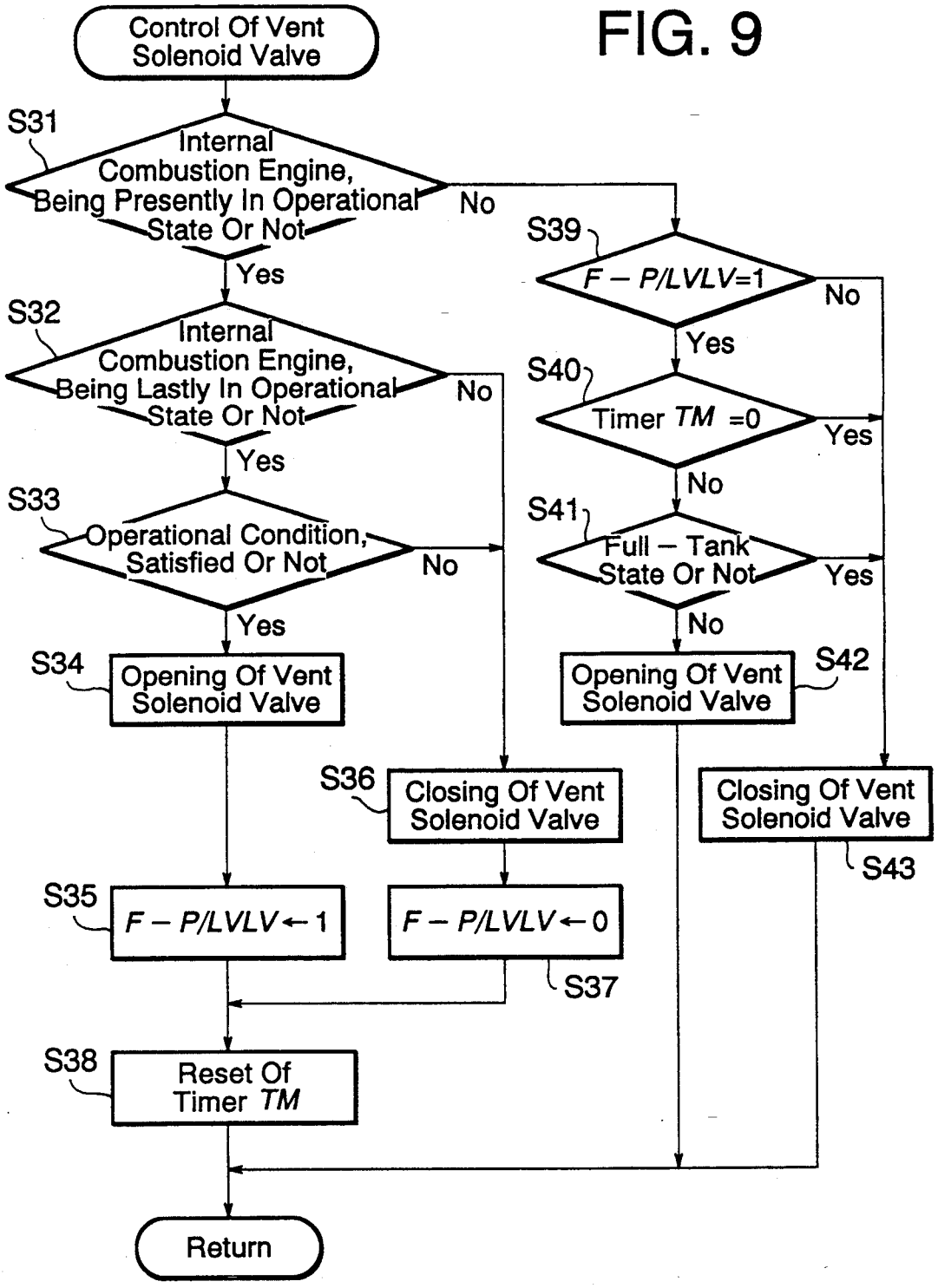
FIG. 9
Control Of Vent Solenoid Valve
S31
Internal Combustion Engine, Being Presently In Operational State Or Not
No
Yes
S32
Internal Combustion Engine, Being Lastly In Operational State Or Not
No
Yes
S33
Operational Condition, Satisfied Or Not
No
Yes
S34
Opening Of Vent Solenoid Valve
S35
F – P/LVLV ← 1
S36
Closing Of Vent Solenoid Valve
F – P/LVLV ← 0
S37
S38
Reset Of Timer TM
Return
S39
F – P/LVLV=1
No
Yes
S40
Timer TM =0
Yes
No
S41
Full – Tank State Or Not
Yes
No
Opening Of Vent Solenoid Valve
S42
Closing Of Vent Solenoid Valve
S43

EVAPORATIVE FUEL PROCESSING SYSTEM FOR INTERNAL COMBUSTION ENGINE

FIELD OF THE INVENTION

The present invention relates to a system for processing an evaporative fuel in a fuel tank of an internal combustion engine mainly to be mounted on a vehicle.

BACKGROUND OF THE INVENTION

In general, a filler tube of a fuel tank includes a vent tube branched from the upper portion thereof and opened at a specified height in the fuel tank. In refueling, when the fuel level in the fuel tank reaches the position of the opening of the above vent tube, the vent tube is blocked by the fuel to close up the inside of the tank. Accordingly, the tank internal pressure is increased, and the fuel is raised in the filler tube by the above internal pressure. Then, when the fuel reaches the opening portion of the filler tube, the refueling is stopped by the actuation of an auto-stop of a fuel nozzle or the visual checking of this state by an operator, thus regulating the full-tank fuel level. At this time, the tank internal pressure is increased up to a pressure corresponding to the height of the fuel raised up to the opening portion of the filler tube.

Conventionally, there has known an internal combustion engine of a type that, to avoid an excessive rise or reduction in pressure inside a fuel tank caused by a variation in the outside air temperature and the like, in a vent passage for communicating the upper space of the fuel tank to a canister, there is provided a two-way valve for allowing a gas flow from a tank side to a canister side when the tank internal pressure is raised, and from the canister side to the tank side when the tank internal pressure is reduced. In such an internal combustion engine, the two-way valve is set in such a manner that the valve opening set-up pressure at the time of flowing the gas from the tank side to the canister side is equal to at least the tank internal pressure necessary for regulating the full-tank fuel level in feeding the fuel.

However, in recent years, in the viewpoint of the environmental problem, there has been required a technique of eliminating the vapor released to the atmospheric air upon opening the cap of the fuel tank for refueling, that is, the so-called puff loss technique. Accordingly, the internal pressure must be equal to or less than the atmospheric pressure upon opening the cap.

An evaporative fuel processing system for satisfying the above requirement has been already proposed, in Japanese Utility Model Application No. hei 3-3883 (1991) by the present applicant.

FIG. 12 shows the above evaporative fuel processing system. A two-way valve 02 and a vent solenoid valve 03 are interposed in parallel to each other in a vent passage 01 for communicating the upper space of an fuel tank T to a canister C, and further, a negative pressure preventive valve 04 is interposed in series to the vent solenoid valve 03. The canister C is communicated to an intake system of an internal combustion engine E by means of a purge passage 05.

In stoppage of the internal combustion engine E, the vent solenoid valve 03 is closed. When the evaporative fuel is generated in the fuel tank T by an increase in the outside air temperature and the like, and the tank internal pressure is increased to be a predetermined value or more, one valve of the two-way valve 02 is opened, and the evaporative fuel in the fuel tank T is introduced to the canister C to be absorbed therein. Thus, it is possible to suppress an excessive rise in the internal pressure of the fuel tank T.

On the contrary, when the internal pressure in the fuel tank T is reduced to be a predetermined value or less by a drop in the outside air temperature and the like, the other valve of the two-way valve is opened, so that the fuel tank T is communicated to the canister C, which makes it possible to avoid an excessive reduction in the pressure within the fuel tank T.

During operation of the internal combustion engine E, the vent solenoid valve 03 is opened, and the upper space in the fuel tank T is communicated to the canister C and the intake system of the internal combustion engine E irrespective of the above two-way valve, which makes it possible to keep the internal pressure in the fuel tank T at the atmospheric pressure or less.

The canister C has an extending ventilation tube 06 at the lower end. Accordingly, in opening the vent solenoid valve 03, the pressure in the fuel tank T can be kept approximately at the atmospheric pressure. However, when there occurs a blocking in the ventilation tube 06 by any cause, the negative pressure in the intake system of the internal combustion engine E is transmitted up to the inside of the fuel tank T through the purge passage 05, which cause a problem of excessively reducing the tank internal pressure. In such a case, the above phenomenon is prevented by closing the negative pressure preventive valve 04.

In the evaporative fuel processing system as shown in FIG. 12, however, in the state that the vent solenoid valve 03 is opened, for example, in operation of the internal combustion engine E, the canister C is forcibly communicated to the fuel tank T, so that the variation in the negative pressure in the canister C generated by a change in the purge amount due to the intake negative pressure of the internal combustion engine E is transmitted to the inside of the fuel tank T as it is, which exerts an adverse effect on the tank strength and the durability. Also, the rapid drop in the internal pressure of the fuel tank has also a problem of causing the vapor lock. Further, the purge amount of the evaporative fuel to the canister C is increased, which promotes the deterioration of the canister C, and the concentration of the air-fuel mixture purged to the internal combustion engine E is largely varied, which makes it difficult to accurately control the air-fuel ratio, thereby causing a problem of deteriorating the purification of the exhaust gas and driveability.

Still further, there is the following disadvantage. Namely, during normal refueling, the upper space of the inside of the fuel tank is closed to obstruct the refueling from exceeding the full-tank fuel level. However, when refueling is performed in a state that the engine is operated, or in the early stage even if after stopping the engine, since the vent solenoid valve 03 is opened and the fuel tank is communicated to the canister, the closing state of the fuel tank cannot be secured, which brings the state of enabling further refueling.

Thus, there is a problem of further continuing refueling, that is, bringing the so-called excessive refueling state. This causes such inconveniences that, in running of an automobile, the fuel in the fuel tank is blown-off from the filler port by the expansion of the fuel or the oscillation of the fuel surface due to the vibration, turning and the like of the vehicle, or the fuel is allowed to flow into the vent passage and to permeate into the canister, resulting in the deterioration of the activated charcoal and the leakage of the fuel from the canister.

SUMMARY OF THE INVENTION

According to a first aspect of the present invention, there is provided an evaporative fuel processing system for an internal combustion engine having the following construction. Namely, there are provided a vent passage for communicating an upper space of a fuel tank to a canister, and a purge passage for communicating the canister to an intake system of the internal combustion engine. The above vent passage is provided with a pressure valve intended to be opened when the pressure in the fuel tank is not less than a pressure for regulating the full-tank fuel level in feeding the fuel to the tank. Further, the above purge passage is provided with a purge control valve for controlling a purge amount of an evaporative fuel according to the operational state of the internal combustion engine. There is further provided a set-up pressure changing means for changing a valve opening set-up pressure of the pressure valve from a first valve opening set-up pressure equivalent to the pressure for regulating the full-tank fuel level to a second valve opening set-up pressure lower than the first valve opening set-up pressure in a predetermined operational state of the internal combustion engine.

During operation of the internal combustion engine, the above pressure valve is set at the lower second valve opening set-up pressure, and accordingly, the pressure in the fuel tank has been reduced in starting the refueling to the fuel tank, which makes it possible to prevent the evaporative fuel from being released through a filler port even if a filler cap is removed.

In the case that the pressure in the fuel tank is lower than the above second valve opening set-up pressure even during operation of the internal combustion engine, the above pressure valve is closed, and the purge of the evaporative fuel from the fuel tank to the intake system of the internal combustion engine through the canister is prevented, which makes it possible to prevent the deterioration of the canister and to accurately control the air-fuel ratio.

According to a second aspect of the present invention, in the above evaporative fuel processing system, there are further provided a fuel level detecting means for detecting the fuel level in the fuel tank and/or an operation/stoppage detecting means for detecting whether the internal combustion engine is in the operational state or in the stopped state. With this construction, when the fuel level detecting means detects the fuel level to be a predetermined height or more and/or a predetermined time elapses after the transition to the stopped state of the internal combustion engine, the above pressure valve is set at the first valve opening set-up pressure.

Thus, even when refueling is performed in the operational state of the internal combustion engine, or in the early stage after the stoppage of the internal combustion engine, it is possible to prevent the excessive refueling in the fuel tank.

BRIEF DESCRIPTION OF THE DRAWINGS

FIG. 7 is a control flow chart of an electronic control unit of the embodiment of FIG. 5;

FIG. 8 is a flow chart for the full-tank judgment subroutine in the flow chart of FIG. 7;

FIG. 9 is a control flow chart showing another control system;

DESCRIPTION OF THE PREFERRED EMBODIMENTS

Figure 1:
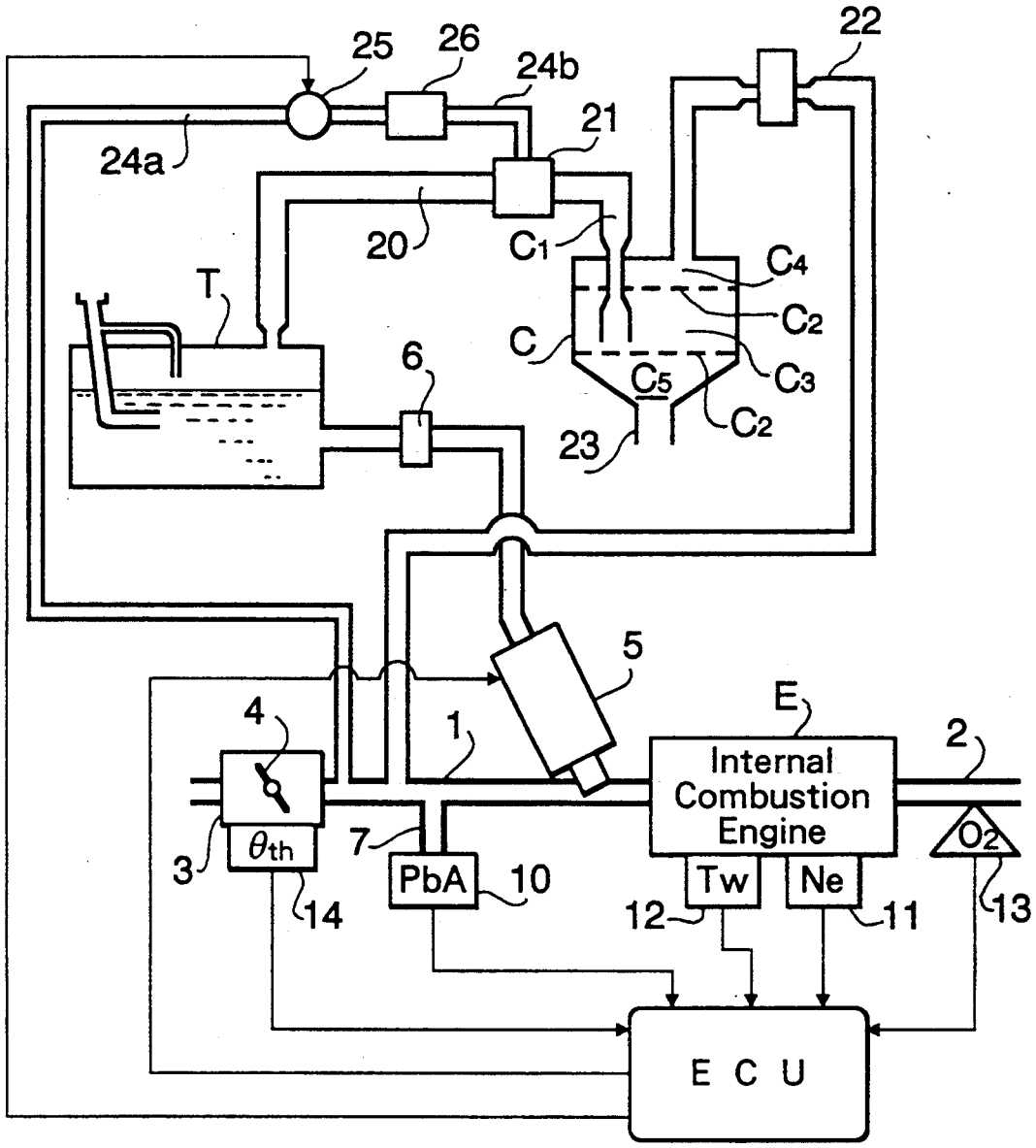
FIG. 1 is a view showing constitution of one embodiment of the present invention.
Figure 2:
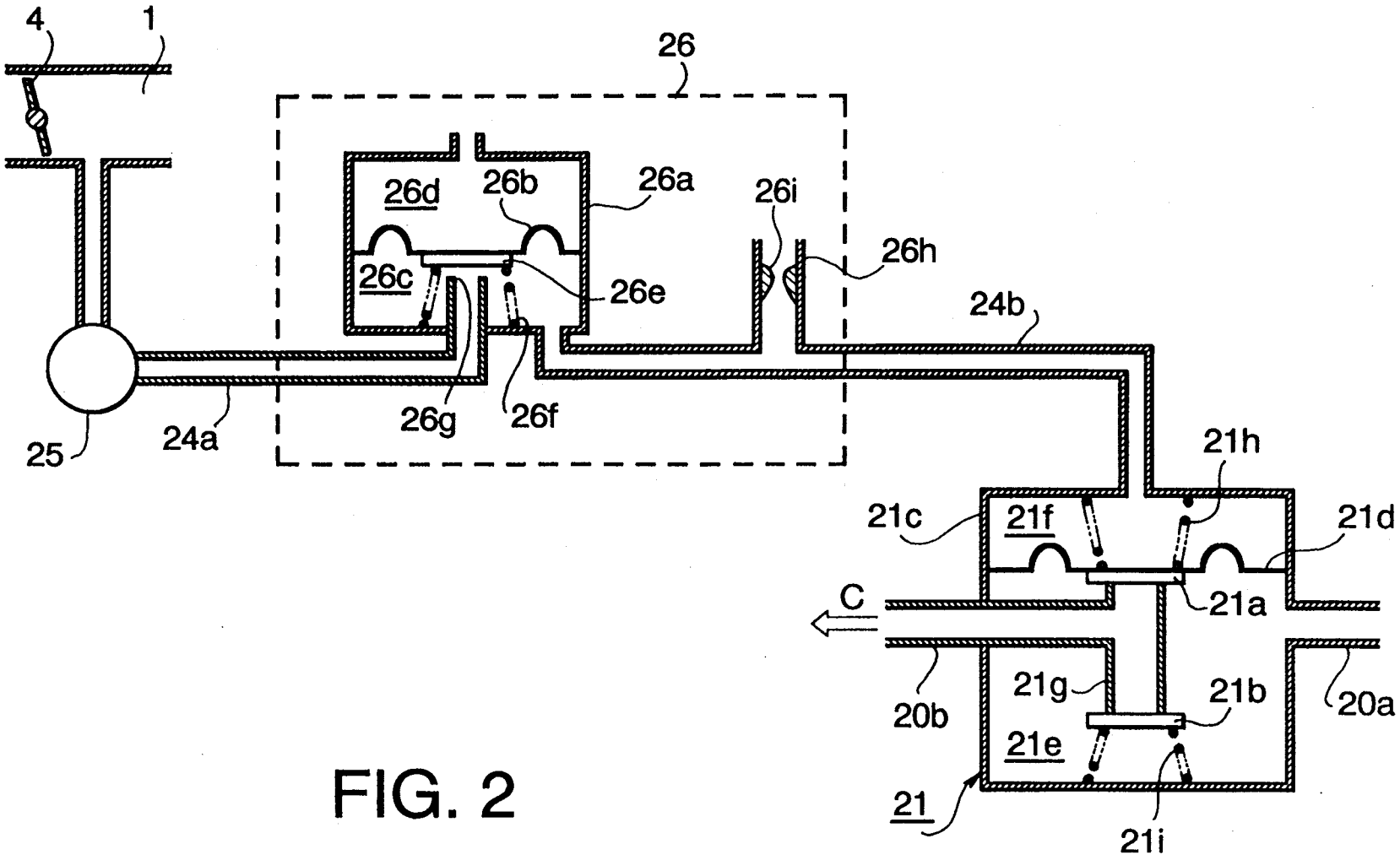
FIG. 2 is a detailed view of a pressure valve system.

FIG. 1 and 2 shows one embodiment of the present invention.

Reference character E indicates an internal combustion engine mounted on an automobile, and which sucks an air-fuel mixture through an intake tube 1 to obtain a power by the combustion thereof, and discharges the exhaust gas after the combustion through an exhaust tube 2. The intake tube 1 is formed with a throttle body, in which a throttle valve 4 is disposed. A fuel injection valve 5 is provided on the downstream side from the throttle valve 4 and on the upstream side from an intake valve (not shown) of the internal combustion engine E. The fuel injection valve 5 is connected to a fuel tank T through a fuel pipe 6.

Means for detecting the operational states of the internal combustion engine E are additionally provided as follows: An intake tube absolute pressure sensor 10 for detecting an absolute pressure PbA in the intake tube 1 is provided on a branch tube 7 on the downstream side from the throttle valve 4. An engine rotational speed sensor 11 for detecting an engine rotational speed Ne is provided around a cam shaft or crank shaft (not shown) of the internal combustion engine E, and which transmits a TDC signal pulse at a predetermined crank angle position for each 180° rotation of the crank shaft of the internal combustion engine E.

An engine coolant temperature sensor 12 for detecting an engine coolant temperature Tw is additionally provided on a main body of the internal combustion engine E. An $O_2$ sensor 13 for detecting an oxygen concentration in the exhaust gas is disposed on the exhaust tube 2 of the engine E. A throttle valve opening sensor 14 for detecting the opening of the throttle valve 4 is disposed on the throttle valve 4.

The detection signals from the above sensors are input in an electronic control unit ECU, which performs an arithmetic processing on the basis of the input informations, and outputs each control signal to each drive unit for optimum control.

For example, the electronic control unit ECU controls various engine operational states such as a feedback control operational area according to the oxygen concentration in the exhaust gas detected by the above $O_2$ sensor 13 and an open loop control operational area, on the basis of the signal from each sensor. Further, it calculates a fuel injection time $T_{OUT}$ of the fuel injection valve 5 synchronously with the above TDC signal pulse according to the engine operational states, and performs the duty control of the fuel injection valve 5 on the basis of the fuel injection time TOUT, to thereby feed the desired amount of the fuel to the internal combustion engine E.

In the internal combustion engine E including such an electronic control type fuel injection apparatus, there is provided an evaporative fuel processing mechanism for processing the evaporative fuel in the fuel tank T without any leakage to the outside.

A vent passage 20 communicated to the upper space in the fuel tank T mounted on the automobile extends from the upper wall of the fuel tank T and is connected to an inlet tube $C_1$ projectingly provided on the upper wall of the canister C. A two-way valve 21, which includes a pair of one-way valves 21*a* and 21*b* (see FIG. 2) disposed oppositely and in parallel to each other, is interposed in the vent passage 20.

In the vessel of the canister C, a space put between the upper and lower filters $C_2$ is filled with an activated charcoal $C_3$. An outlet chamber $C_4$ in the upper space is communicated to the downstream side from the throttle valve 4 in the intake tube 1 through a purge passage 22, and an atmospheric air chamber $C_5$ in the lower space is communicated to the atmospheric air through a ventilation tube 23.

A valve case 21*c* of the two-way valve 21 is partitioned in a valve chamber 21*e* and a negative pressure chamber 21*f* by means of a diaphragm 21*d*. The valve chamber 21*e* is connected to a vent passage 20*a* near the fuel tank T, and the negative pressure chamber 21*f* is connected to the downstream side from the throttle valve 4 in the intake tube 1 through a negative pressure tube 24. A valve seat sleeve 21*g* is connected to a vent passage 20*b* near the canister C.

The one-way valve 21*a*, which is intended to be opened when the internal pressure in the fuel tank T is higher than that in the canister C, is additionally provided on the lower surface of the diaphragm 21*d*, and is pressed on the upper surface of the valve seat sleeve 21*g* by means of the spring force of a valve spring 21*h*. The one-way valve 21*b* which is intended to be opened when the internal pressure of the fuel tank T is lower than that in the canister C, is pressed on the lower surface of the valve seat sleeve 21*g* by the spring force of a valve spring 21*i*.

In the case that the pressure in the negative pressure chamber 21*f* is the atmospheric pressure, the one-way valve 21*a* is opened when the pressure in the valve chamber 21*e* is raised up to be P1 or more. Namely, the valve opening set-up pressure of the one-way valve 21*a* in such a case is P1. In the case that the pressure in the negative pressure chamber 21*f* is a negative pressure $P_N$ set by a negative pressure setting unit 26, the one-way valve 21*a* is opened when the pressure in the valve chamber 21*e* is raised up to be P2, which is smaller than P1, or more. Namely, the valve opening set-up pressure of the one-way valve 21*a* in such a case is P2.

A solenoid valve 25 and the negative pressure setting unit 26 are interposed in series in the negative pressure tube 24. A valve case 26*a* of the negative pressure setting unit 26 is partitioned in a negative pressure chamber 26*c* and an atmospheric pressure chamber 26*d* by means of a diaphragm 26*b*, and a negative pressure valve 26*e* is additionally provided on the lower surface of the diaphragm 26*b*. The negative pressure valve 26*e* is separated from a valve seat 26*g* near the intake tube 1 by means of the spring force of a valve spring 26*f*. Thus, when the solenoid valve 25 is opened, and a negative pressure Pb is introduced to the negative pressure chamber 26*c* of the negative pressure setting unit 26 and is reduced to be a predetermined value or less, the diaphragm 26*b* and the negative pressure valve 26*e* descend against the spring force of the valve spring 26*f*, so that the negative pressure valve 26*e* is abutted on the valve seat 26*g* to be thus closed. In addition, a restrictor 26*i* is provided on a branch tube 26*h* branched from the negative pressure tube 24*b* near the two-way valve 21, and the branch tube 26*h* is opened to the atmospheric air.

In the state that the internal combustion engine E is stopped, the electronic control unit ECU does not transmit any signal to the solenoid valve 25 and the solenoid valve 25 is not operated to be thus closed, so that the negative pressure Pb in the intake tube 1 is not introduced in the negative pressure chamber 21*f* of the two-way valve 21. Accordingly, when the pressure in the fuel tank T is raised up to the above valve opening set-up pressure P1 or more, the one-way valve 21*a* is opened, and the evaporative fuel in the fuel tank T is introduced in the canister C to be absorbed by the canister C, or is discharged on the downstream side from the throttle valve 4 of the intake tube 1 through the purge passage 22 to be sucked in the internal combustion engine E together with the air-fuel mixture.

In the state that the internal combustion engine E is kept to be operated, the solenoid valve 25 is operated to be thus opened by the output from the electronic control unit ECU, and the intake negative pressure Pb in the intake tube 1 is introduced to the negative pressure chamber 21*f* of the two-way valve 21 through the negative pressure tube 24 and the negative pressure setting unit 26. Accordingly, when the pressure in the fuel tank T is raised up to the second valve opening set-up pressure P2 lower than the above first valve opening set-up pressure P1, the one-way valve 21*a* is opened, and the evaporative fuel in the fuel tank T is discharged to the downstream side from the throttle valve 4 in the intake tube 1 through the two-way valve 21, the canister C and the purge passage 22, to be thus sucked in the internal combustion engine E together with the air-fuel mixture.

Thus, the pressure in the fuel tank T is kept to be the second valve opening set-up pressure P2 or less during operation of the engine, and which is capable of being raised up to the first valve opening set-up pressure P1 higher than the second valve opening set-up pressure P2 in stopping of the internal combustion engine. Accordingly, by setting the second valve opening set-up pressure P2 approximately at the atmospheric pressure, and setting the first valve opening set-up pressure P1 at a pressure necessary for regulating the full-tank fuel level during refueling, it is possible to regulate the full-tank fuel level by increasing the internal pressure of the fuel tank T, while preventing the vapor from being released to the atmospheric air when the cap of the fuel tank is opened.

Figure 3:
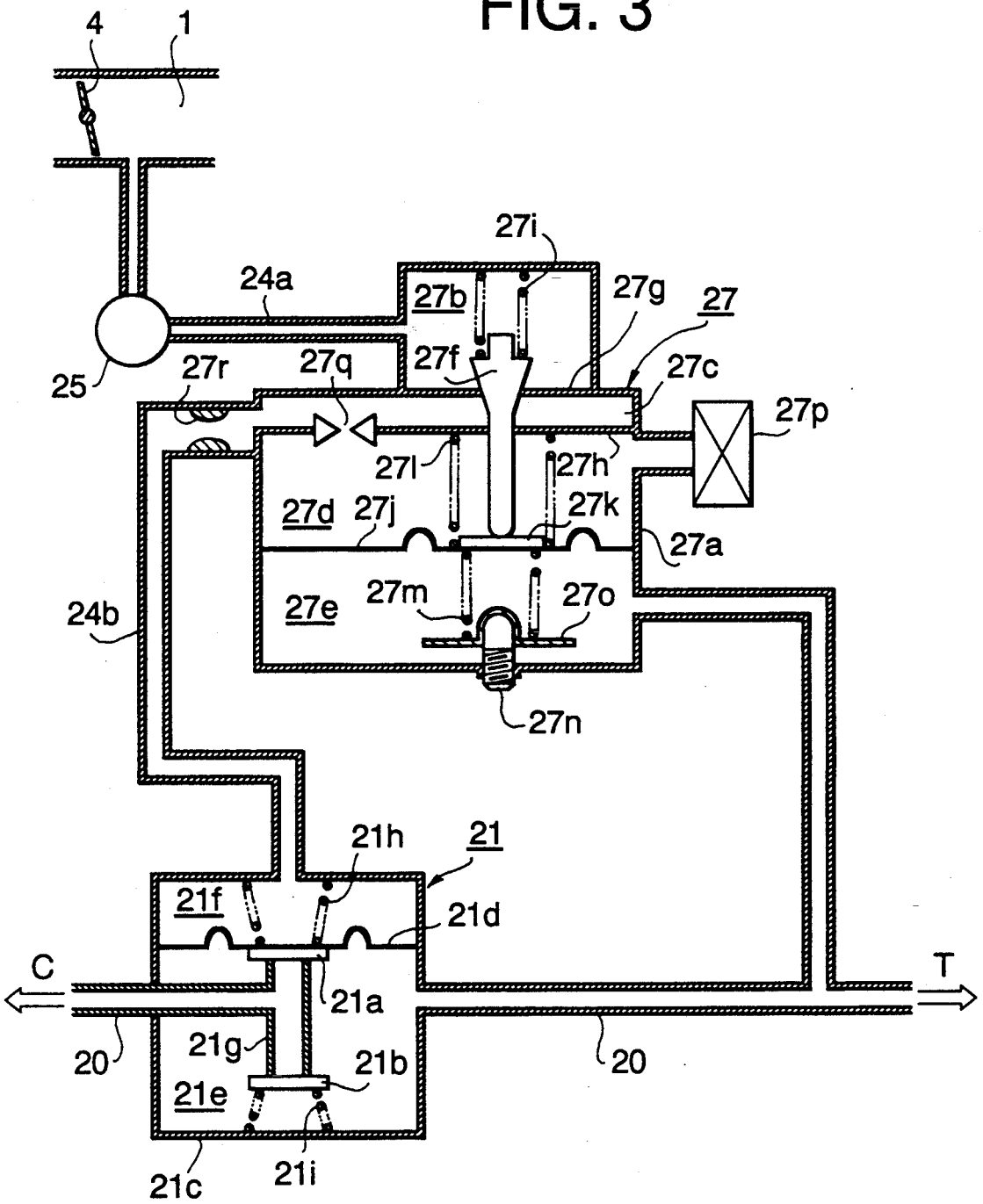
FIG. 3 is a detailed view showing one modification of the pressure valve system.

In the embodiment as shown in FIGS. 1 and 2, the negative pressure setting unit 26 is used for controlling the pressure in the negative pressure chamber 21*f* of the two-way valve 21. However, a negative pressure amplifier 27 as shown in FIG. 3 may be used.

A valve case 27*a* of the negative pressure amplifier 27 is partitioned in a negative pressure introducing chamber 27*b*, a negative pressure communicating chamber 27*c*, an atmospheric pressure introducing chamber 27*d* and a tank internal pressure introducing chamber 27*e*. The negative pressure introducing chamber 27*b* is connected to the downstream side from the throttle valve 4 in the intake tube 1 through the negative pressure tube 24*a*. A tapered portion of a negative pressure control valve 27*f* passes through a bulkhead 27*g* for partitioning the negative pressure introducing chamber 27*b* from the negative pressure communicating chamber 27*c*, and the parallel portion of the negative pressure control valve 27*f* passes through a bulkhead 27*h* for partitioning the negative pressure communicating chamber 27*c* from the atmospheric pressure introducing chamber 27*d*. The negative pressure control valve 27*f* is energized downwardly by the spring force of a valve spring 27*i*.

An abutment piece 27*k* additionally provided on the upper surface of a diaphragm 27*j* for partitioning the atmospheric pressure introducing chamber 27*d* from the tank internal pressure introducing chamber 27*e* receives the negative pressure control valve 27*f* from the lower side. A diaphragm spring 271 is interposed between the bulkhead 27*h* and the diaphragm 27*j*, and a diaphragm spring 27*m* is interposed between a receiving piece 27*o* abutted on the upper end of an adjustment screw 27*n* screwed to the lower wall of the valve case 27*a* and the diaphragm 27*j*.

The atmospheric pressure introducing chamber 27*d* is communicated to the atmospheric air through a filter 27*p*, and is communicated to a negative pressure communicating chamber 27*c* through a restrictor 27*q*. The negative pressure communicating chamber 27*c* is communicated to a negative pressure chamber 21*f* of a two-way valve 21 through a restrictor 27*r*.

Since the modification as shown in FIG. 3 is so constructed as described above, in the case of no output from the electronic control unit ECU to the solenoid valve 25, the solenoid valve is closed, and the negative pressure Pb in the intake tube 1 is not introduced in the negative pressure introducing chamber 27*b*, so that the negative pressure control valve 27*f* is closed by the valve spring 27*i* and the negative pressure is not introduced to the negative pressure chamber 21*f* of the two-way valve 21. Thus, the valve opening set-up pressure of the one-way valve 21*a* of the two-way valve 21 is set at the first valve opening set-up pressure P1.

On the contrary, in the case that the solenoid valve 25 is opened by the output from the electronic control unit ECU, the negative pressure Pb in the intake tube 1 is introduced to the negative pressure introducing chamber 27*b*, so that the negative pressure control valve 27*f* is raised against the spring force of the valve spring 27*i*, to be thus opened, and the negative pressure introducing chamber 27*b* is communicated to the negative pressure communicating chamber 27*c* and the negative pressure chamber 21*f* of the two-way valve 21. Thus, the negative pressure chamber 21*f* is set at a negative pressure Px corresponding to the opening areas of the restrictors 27*q* and 27*r*.

As the internal pressure of the fuel tank T is raised, the rise in the pressure is introduced in the tank internal pressure introducing chamber 27*e*, and the diaphragm 27*j* is deformed upwardly to increase the opening of the negative pressure control valve 27*f*, so that the pressure in the negative pressure communicating chamber 27*c* and the negative pressure chamber 21*f* of the two-way valve 21 becomes a negative pressure $P_y$ larger than the above negative pressure $P_x$. Namely, the negative pressure is amplified. Accordingly, the one-way valve of the two-way valve 21 is opened when the pressure in the fuel tank T reaches a pressure smaller than the above first valve opening set-up pressure P1, that is, the second valve opening set-up pressure P2, and the evaporative fuel in the fuel tank T is absorbed in the intake tube 1 in the internal combustion engine E.

Figure 4:
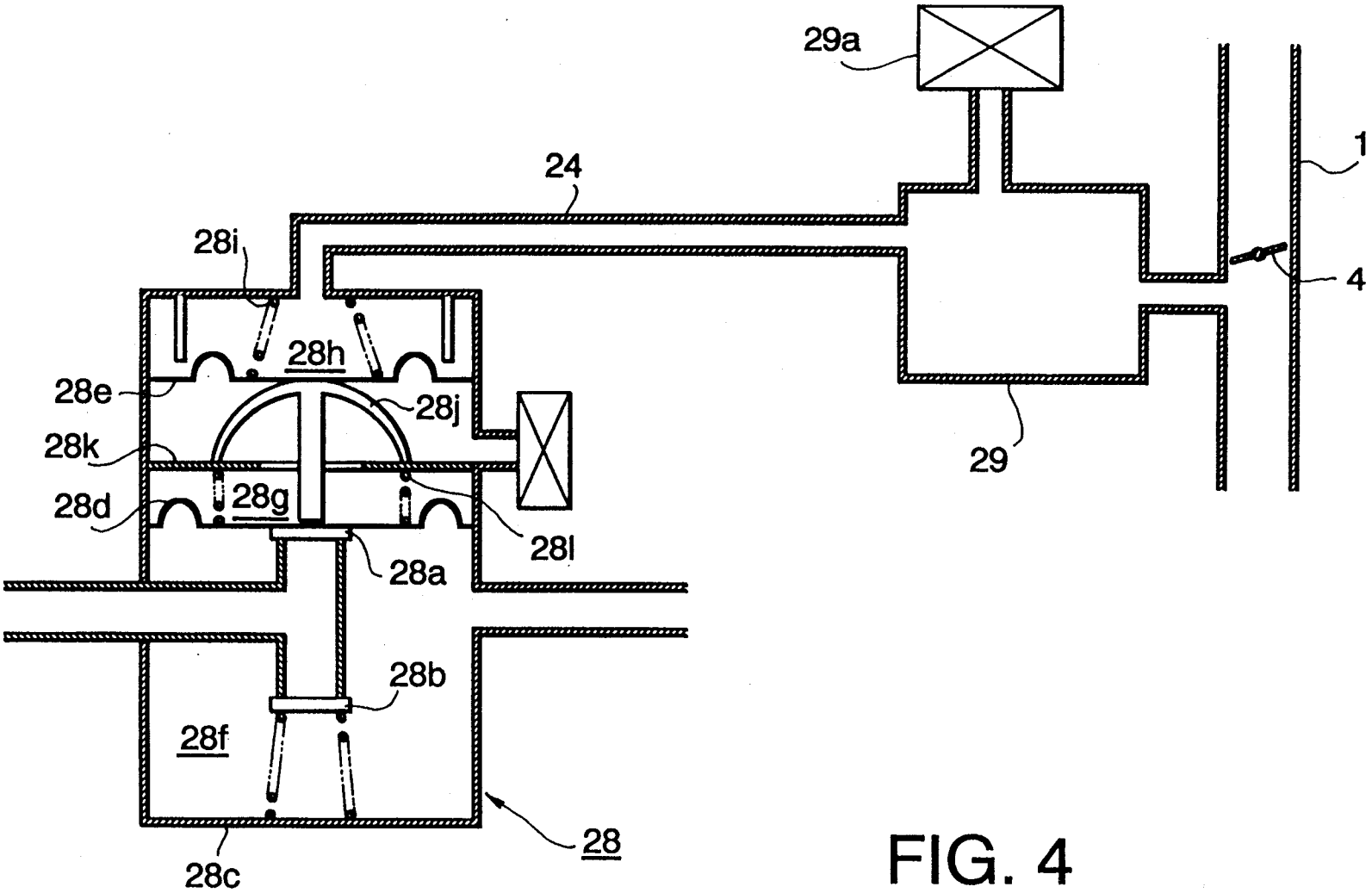
FIG. 4 is a detailed view showing another modification of the pressure valve system.

Next, there will be described a modification as shown in FIG. 4. A two-way valve 28 as shown in FIG. 4 is constituted of one-way valves 28*a* and 28*b* similar to the one-way valves 21*a* and 21*b* of the two-way valve 21 of FIG. 2. A valve case 28*c* is partitioned in a valve chamber 28*f*, adjusting chamber 28*g*, and a negative pressure chamber 28*h* by means of diaphragms 28*d* and 28*e*. The uppermost negative pressure chamber 28*h* is connected to the downstream side from the throttle valve 4 in the intake tube 1 through a negative pressure tube 24. A solenoid valve 29 is interposed in the negative pressure tube 24. The negative pressure tube 24 is cut-off its connection to the intake tube 1 in the non-operational state of the solenoid valve 29, and is communicated to the atmospheric air through a filter 29*a*, whereas it is connected to the intake tube 1 in the operational state, to thus introduce the negative pressure Pb in the intake tube 1 into the negative pressure chamber 28*h*.

A transmitting member 28*j* is disposed in the adjusting chamber 28*g*, and the branching portion of the transmitting member 28*j* is engaged with a spring plate 28*k* in such a manner that the vertex portion of the transmitting member 28*j* is abutted on the diaphragm 28*e*. The diaphragm 28*e* is pressed downwardly by means of a valve spring 28*i*. A spring 28*l* is interposed between the spring plate 28*k* and the diaphragm 28*d*, and the vertical motion of the diaphragm 28*e* is transmitted to the diaphragm 28*d* through the transmitting member 28*j*.

Figure 5:
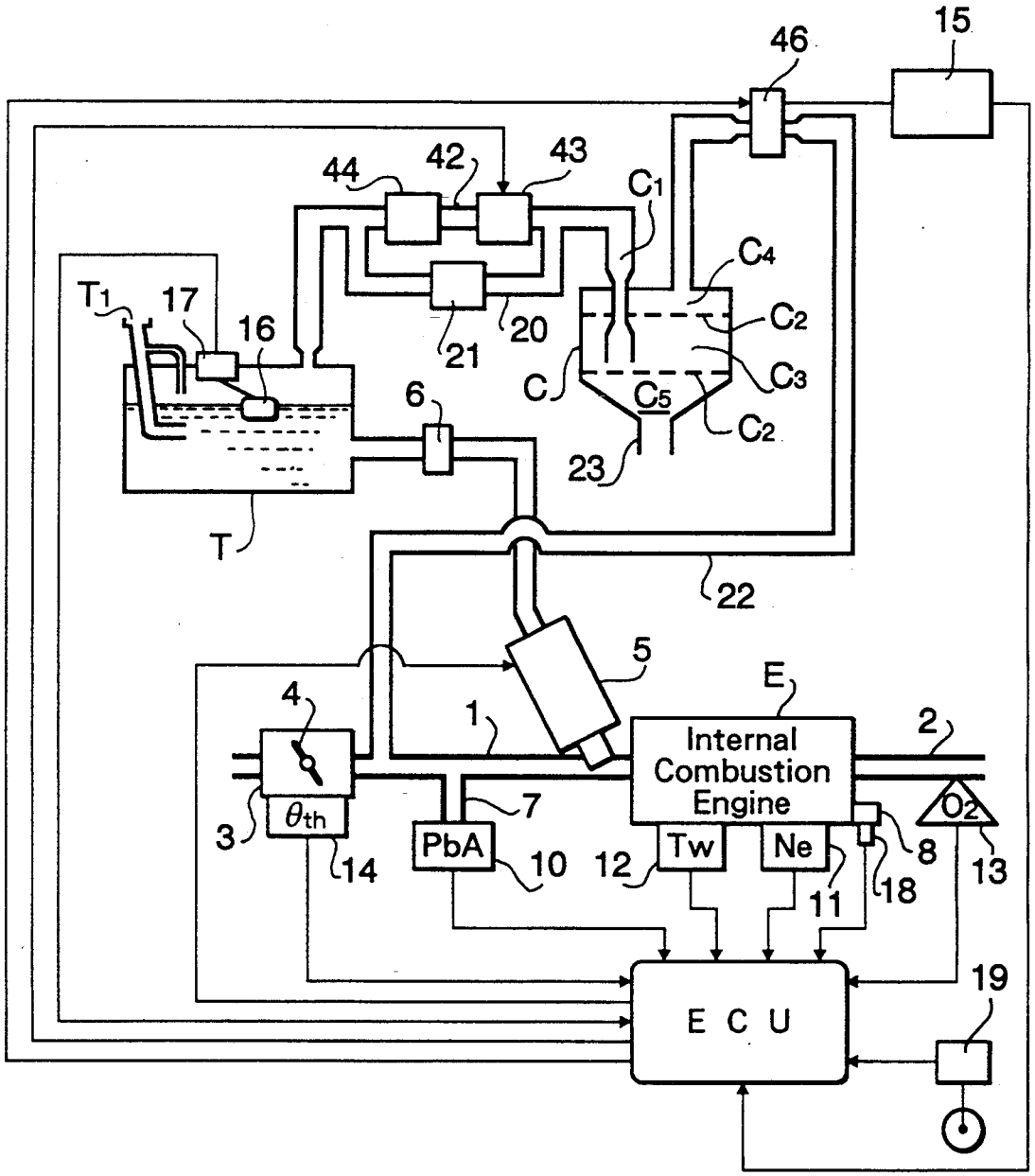
FIG. 5 is a view showing constitution of another embodiment of the present invention.

FIG. 5 is a view showing another embodiment of the present invention, which is similar to FIG. 1. In this figure, parts corresponding to those in FIG. 1 are indicated by the same reference characters, and the explanation thereof is omitted.

Figure 6:
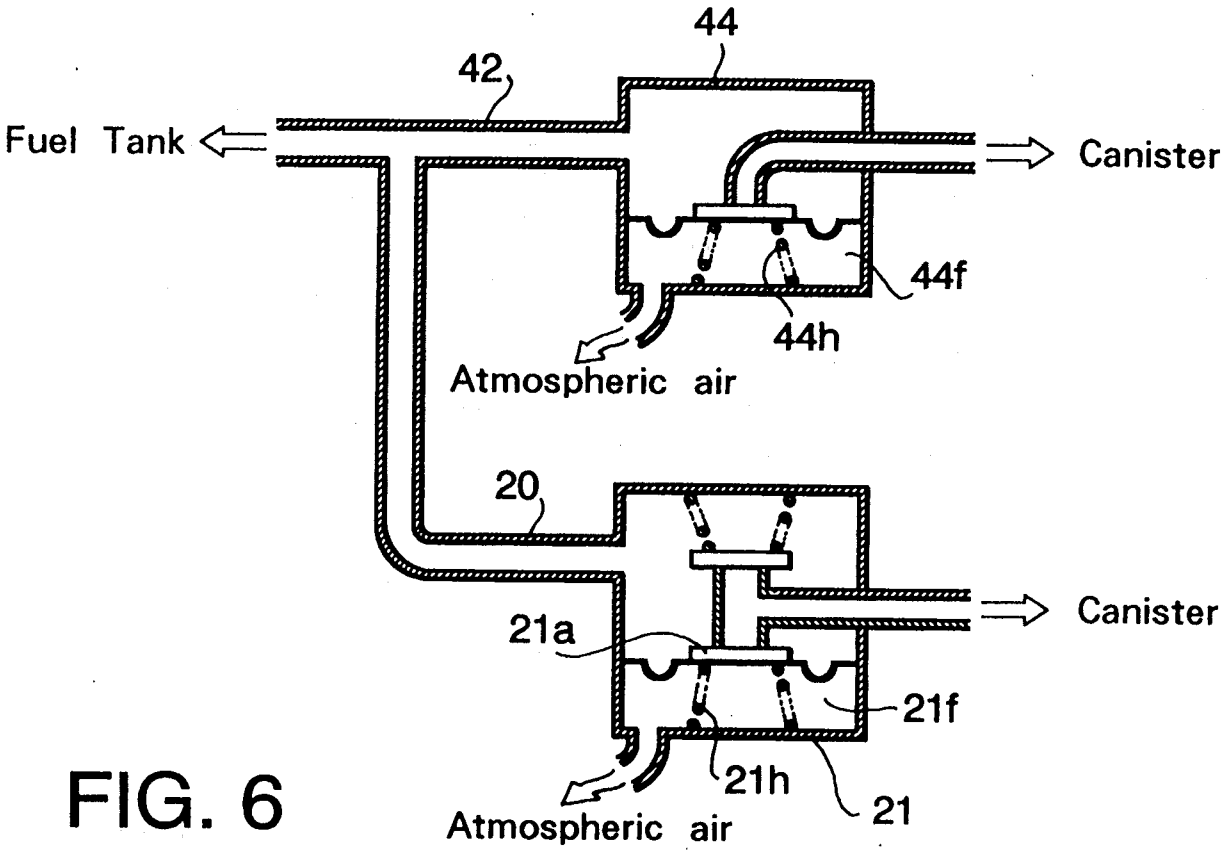
FIG. 6 is a detailed view showing a part of FIG. 5.

In this embodiment, a vent solenoid valve 43 and a one-way valve 44 are interposed in series in a bypass passage 42 bypassing a two-way valve 21. One one-way valve 21*a* (FIG. 6) of the two-way valve 21 is set at the above first valve opening set-up pressure P1. And, the one-way valve 44 is set at a second valve opening set-up pressure P2 (slightly higher than the atmospheric pressure). Namely, as shown in FIG. 6, a chamber 21*f* of the two-way valve 21 is usually communicated to the atmospheric pressure, similarly, the one-way valve 44 is also provided with an atmospheric pressure chamber 44*f*, and a valve spring 44*h* of the one-way valve 44 is made to be weaker than a valve spring 21*h* of the two-way valve 21.

A purge solenoid valve 46 provided on a purge passage 22 is additionally provided with a purge detecting means 15, and the fuel tank T is additionally provided with a fuel oil level detecting means 17 for detecting a predetermined oil level by a float 16. The detection signals from these detecting means are transmitted to the electronic control unit ECU.

Also, an ignition system 8 additionally provided on the above internal combustion engine E is provided with an operation/stoppage sensor 18 for detecting whether or not the internal combustion engine E is operated. Further, there is provided a car speed sensor 19. The detection signals from these sensors are transmitted to the electronic control unit ECU.

The electronic control unit ECU is actuated according to the flow chart as shown in FIG. 7.

Namely, in a step S1, it is determined whether or not the operation of the internal combustion engine E is started by the output of the operation/stoppage sensor 18. If not, the flow advances to steps 2 and 3, in which the vent solenoid valve 43 is operated to be closed, and also the solenoid valve flag is set at "0" (F-P/LVLV=0).

If the operation is started in the step S1, the flow advances to a step 4, in which it is determined whether or not a car speed $V_p$ is a predetermined car speed $V_{PSTP}$ or more. If being less than the predetermined car speed $V_{PSTP}$, in a step 5, it is determined whether or not a predetermined time tmstp elapses. If elapsing, the flow advances to a step 6. If not, the flow advances to a step 8, in which a timer TMFLCHK is reset.

Also, in the step 4, if the car speed Vp is the predetermined car speed VPSTP or more, the flow advances to a step 7, in which the timer TMSTP is reset, and subsequently, in the step 8, the timer TMFLCHK is reset.

When the flow advances to the step 6, in a step 9 of a full-tank judgment subroutine as shown in FIG. 8, it is determined whether or not the vent solenoid valve 43 is presently opened. If being opened, the flow advances to a step 10, in which, it is determined whether or not the fuel level detecting sensor 17 detects a high fuel level Hi or more. If not, the flow advances to a step 11, in which a timer TMFLCHKi is reset.

In the case that the fuel level detecting sensor 17 detects the high fuel level Hi in the step S10, in a step 12, it is determined whether or not a predetermined time tmflchkhi elapses in the timer TMFLCHKHi. If elapsing, the flow advances to a step 13, in which a flag F-FLLO is set at "0".

However, after the timer TMFLCHKHi is reset in the step S11, or if the predetermined time tmflchkhi does not elapse in the timer TMFLCHKHi, the flow advances to the step S17, in which the flag F-FLLO is set at "1".

If the vent solenoid valve 23 is opened in the step S9, the flow advances to the step S14, in which it is determined whether or not the fuel level detecting sensor 17 detects a low fuel level Lo or less. If not, the flow advances to a step S15, in which a timer TMFLCHKLo is reset, and the flow advances to the step S13.

If the fuel level detecting sensor 17 detects the low fuel level Lo or less in the step S14, the flow advances to a step S16, in which it is determined whether or not a predetermined time tmflchklo elapses in the timer TMFLCHKLo. If not, the flow advances to the step S13. If elapsing, the flow advances to the step S17.

Returning to FIG. 7, after passing the subroutine of FIG. 8 in the step S6, the flow advances to a step S18, in which it is determined whether or not the tank is filled up, that is, a flag F-FLLO is set as "0". If not (F-FLLO=1), the flow advances to a step 19, in which it is determined whether or not the purge starting condition of the canister, for example, the condition that the internal combustion engine E is operated at the rotational speed of an idle rotational speed or more, the coolant temperature Tw is a predetermined temperature or more, and the fuel feed control by the $O_2$ feedback control by means of the $O_2$ sensor 13 has been started, is satisfied. If purge starting condition is satisfied, in the step 20, the vent solenoid valve 23 is opened, and in a step 21, a flag F-P/LVLV is set at "1".

However, if the fuel tank is filled up (F-FLLO=0) in the step S18, or if the purge starting condition is not satisfied in the step S19, the flow advances to the step 2 and 3, in which the vent solenoid valve 23 is closed and also a flag F-P/LVLV is set at "0".

In the state that, by such an actuation of the electronic control unit ECU, the internal combustion engine E is operated, the fuel tank is not filled up, and the purge starting condition is satisfied, as shown in FIG. 7, the flow advances to the steps 20 and 21 through the step S1, S4, S5 and S6, or the steps S1, S4, S7 and S8, and further through the steps S18 and S19, in which the vent solenoid valve 43 is opened. Accordingly, the evaporative fuel in the fuel tank T is fed to the intake tube 1 through the bypass passage 42, canister C, purge solenoid valve 46 and purge passage 22, so that the pressure in the fuel tank T is controlled by the one-way valve 44 to be atmospheric pressure or less. Therefore, the evaporative fuel in the fuel tank T is not released to the atmospheric air even if the filler cap $T_1$ is opened.

In the case that the internal combustion engine E is not operated, in the case that the fuel tank is filled up even if the internal combustion engine E is operated, or in the case that the purge starting condition is not satisfied even if the internal combustion engine E is operated and the fuel tank is not filled up, the flow advances to the step S2 and S3, in which the vent solenoid valve 23 is closed, so that the bypass passage 42 is cut-off from the fuel tank T and thus the pressure in the fuel tank is controlled by the two-way valve 21.

Further, in this embodiment, the refueling action is not detected by detecting means such as a lid switch and a cap opening detecting switch, but is assumed by the fact that a predetermined time tmstp elapses in the state that the car speed $V_p$ is the predetermined car speed $V_{PSTP}$ or less. Then, in the full-tank judgment subroutine in the step 6, when the full-tank state is detected by the fact that a predetermined time tmflchklo elapses in the state that the fuel level in the fuel tank T is the full-tank fuel level Hi or more, the solenoid valve is closed, thereby certainly preventing the excessive refueling.

Accordingly, there can be eliminated the necessity of using the lid switch and the cap opening detecting switch which frequently opened and closed, to shorten the service life, thus tending to cause a failure. This makes it possible to improve the durability and reliability in the full-tank detecting system.

The flow charts as shown in FIGS. 7 and 8 are applicable for the evaporative fuel processing system as shown in FIGS. 1 to 4. In this case, the opening/closing control of the solenoid valve 25 or 29 may be performed according to the above flow charts.

The above embodiment is intended to prevent the release of the evaporative fuel and the excessive refueling, mainly when the refueling is performed during the internal combustion engine is in the operational state. Next, there will be described an embodiment of solving the above problems during refueling after stopping of the internal combustion engine.

In this embodiment, the evaporative fuel processing system as shown in FIG. 5 is used, and the control is performed according to a flow chart as shown in FIG. 9.

Entering the main routine, first, in a step 31, it is determined whether or not the internal combustion engine E is presently in the operational state by the output of the operation/stopping sensor 18. If being presently in the operational state, the flow advances to a step S32, in which it is determined whether or not the combustion engine E was in the operational state at the last time. If being lastly in the operational state, the flow advances to a step S33, in which it is determined whether or not a predetermined operational condition is satisfied (equivalent to the steps S4, S5, S6, S7, S8, S18 and S19 as shown in FIG. 7 of the previous embodiment). If being satisfied, the flow advances to a step S34, in which the vent solenoid valve 43 is opened, and subsequently, a flag F-P/LVLV is set at "1" (step S35). Then, the flow advances to a step S38, in which a down timer TM is set at a predetermined time.

If the internal combustion engine is determined not to be lastly in the operational state in the step S32, and if the predetermined condition is determined not to be satisfied in the step S33, the flow is jumped to a step S36, in which the vent solenoid valve 43 is closed, and subsequently, the flag FP/LVLV is reset at "0" (step S37). Then, the flow advances to a step S38, in which a timer TM is reset.

Namely, if the internal combustion engine E was lastly in the stopped state and is presently in the operational state, the flow is jumped from the step S32 to the step S36, in which the vent solenoid valve 23 is closed, and the flag F-P/LVLV is set at "0" and the timer TM is reset.

Thus, from the next time, since the internal combustion engine is lastly in the operational state, the flow advances from the step S32 to step S33, in which it is determined whether or not the predetermined operational state is satisfied. Until being satisfied, the flow is jumped to the step S36, in which the vent solenoid valve 23 is kept to be closed.

If the predetermined operational condition is satisfied, the flow advances from the step S33 to the step S34, in which the vent solenoid valve 23 is opened, and the pressure in the fuel tank is usually reduced during running.

As described above, if the predetermined operational condition is not satisfied during operation of the internal combustion engine, the solenoid valve 23 is closed. If being satisfied, the control for opening the solenoid valve 23 is performed.

Then, when the internal combustion engine is stopped, the flow is jumped from the step S31 to a step 39, in which the state of the flag F-P/LVLV is determined.

The flag F-P/LVLV is a flag to store the state of the solenoid valve 23 directly before the stoppage of the internal combustion engine. If the solenoid valve 23 is closed and the F-P/LVLV=0 is satisfied, the flow is jumped from the step S39 to the step S43, in which the solenoid valve 23 is subsequently kept in the closing state. On the other hand, if the solenoid valve 23 is opened and the F-P/LVLV=1 is satisfied, the flow advances from the step S39 to the step S40.

In the step S40, it is determined whether or not the down timer TM reset in the step S38 has counted a predetermined time and become 0. Until the predetermined time elapses, the flow advances to the step S41. If the predetermined time elapses, the flow is jumped to the step S43, in which the solenoid valve 23 is closed.

When the flow advances to the step S41 within the predetermined time, the flag F-FLLO determines whether or not the fuel tank is filled up.

The step S41 is similar to the step S18 as shown in FIG. 7 of the previous embodiment, in which the judgment of the full-tank is performed by the subroutine as shown in FIG. 8, thus determining the flag F-FLLO.

If not in the full-tank state (F-FLLO=1), the flow advances to a step S42, in which the vent solenoid valve 23 is kept to be opened. If being in the full-tank state (F-FLLO=0), the flow is jumped to a step S43, in which the solenoid valve 43 is closed.

Namely, when the vent solenoid valve 43 is opened and the internal combustion engine is stopped, the flow advances to the steps S31, S39, S40 and S41 until a predetermined time elapses. Then, if not in the full-tank state, the flow advances to the step S42, in which the vent solenoid valve 23 is kept opened. When the predetermined time elapses, the flow advances from the step S40 to the step S43, in which the vent solenoid valve 43 is closed.

Also, if the fuel tank is in the full-tank state before an elapse of the predetermined time, the flow advances from the step S41 to the step S43, in which the vent solenoid valve 43 is closed.

Further, when the operation of the combustion engine is re-started before an elapse of the predetermined time, the flow advances from the step S31 to the step S32 and further the step S36, in which the vent solenoid valve is closed.

As described above, when the internal combustion engine is stopped in the state that the vent solenoid valve 43 is opened, the solenoid valve 43 is kept open for a predetermined time, and accordingly, it is possible to prevent the rise in the tank internal pressure after stoppage. This prevents the evaporative fuel from being released from the filler port even by removing the filler cap. Further, when refueling is performed and the tank is filled up within the predetermined time, the solenoid valve 43 is closed (step S43), so that the upper space of the fuel tank is blocked and the internal pressure in the fuel tank is raised, which makes it possible to obstruct the following refueling and hence to prevent the excessive refueling. Also, it is possible to avoid the inconvenience of causing the fuel leakage or the deterioration of the activated charcoal.

Figure 10:
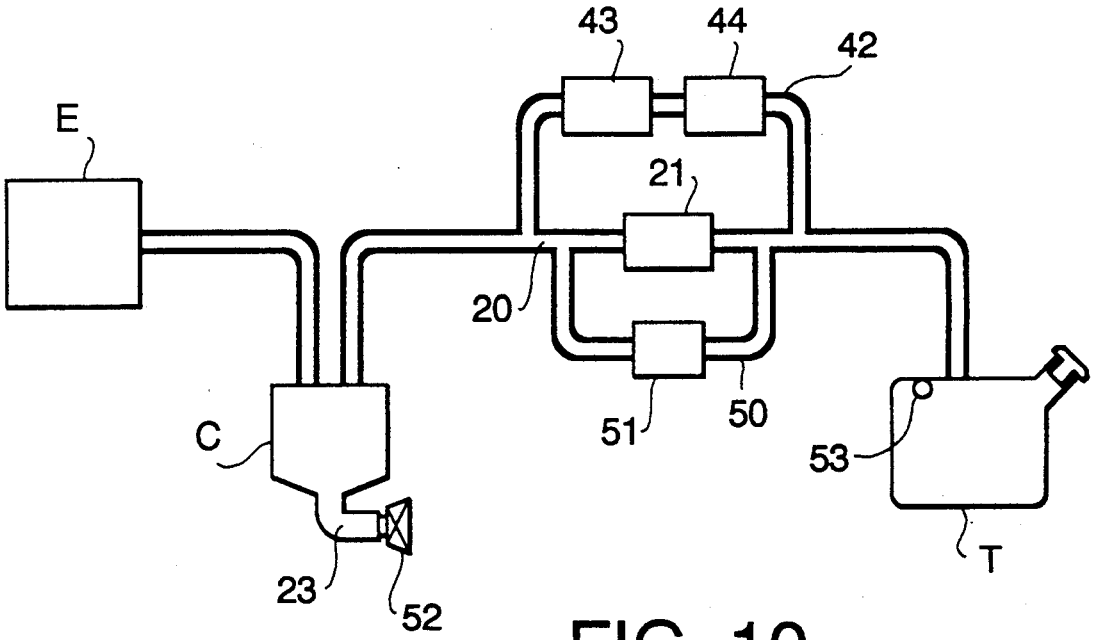
FIG. 10 is a view showing a modification of the embodiment of FIG. 5.

FIG. 10 shows a modification of the evaporative fuel processing system of FIG. 5. In this modification, there is further provided another bypass passage 50 for bypassing the two-way valve 21. The bypass passage 50 is provided with a solenoid valve 51 for detecting the leakage. Also, a solenoid valve 52 is provided on a ventilation pipe 23 communicated to the atmospheric pressure chamber of the canister C, and a tank internal pressure sensor 53 is provided inside the fuel tank T.

In detection of the leakage for the evaporative fuel processing system, the solenoid valve 51 is opened irrespective of the pressure in the fuel tank T, and the solenoid valve 52 is closed, and in such a state, the electronic control unit detects whether or not the detection signal of the tank internal pressure sensor 53 is changed within a predetermined time. If the detection signal is changed, it is determined that the leakage occurred. If not changed, it is determined that the leakage did not occur. Thus, the judgment result is indicated on the display panel at the operator seat.

Figure 11:
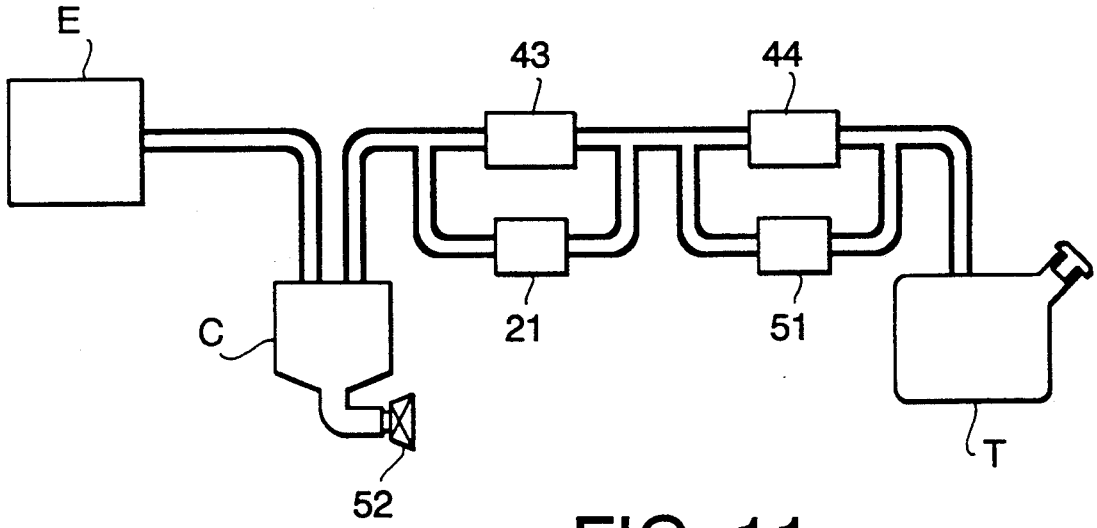
FIG. 11 is a view showing another modification of the embodiment of FIG. 5.
Figure 12:
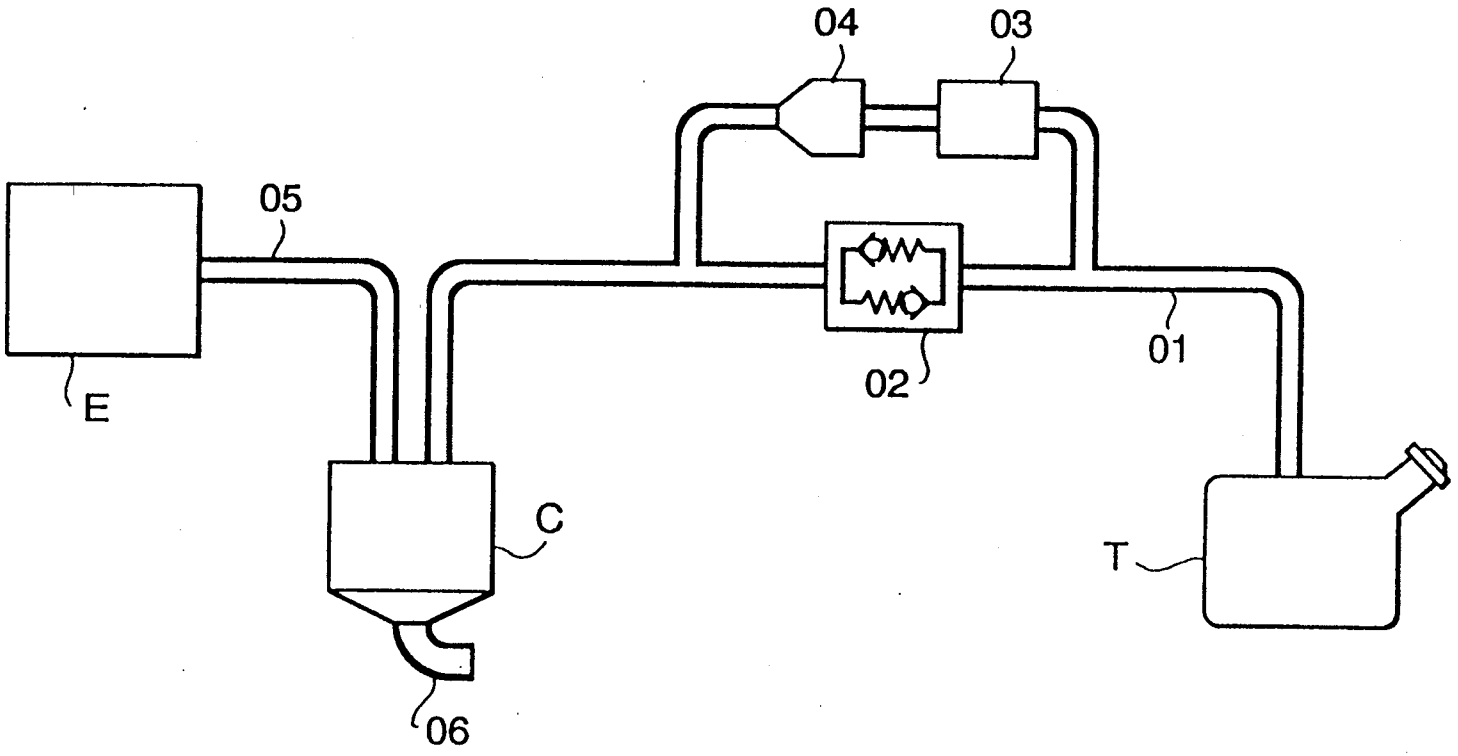
FIG. 12 PRIOR ART
FIG. 12 is a view showing a prior art evaporative fuel processing system.

The two-way valve 21, one-way valve 44, and solenoid valves 43 and 51 may be disposed as shown in FIG. 11. In operation of the internal combustion engine, the solenoid valve 43 is opened while closing the solenoid valve 51. In inspecting the leakage of the evaporative fuel processing system, the solenoid valves 43 and 51 are opened.

What is claimed is:

1. In an evaporative fuel processing control system for an internal combustion engine having an intake system, and a fuel tank, including a canister, a vent passage communicating between an upper space within said fuel tank and an interior of said canister, and a purging passage communicating between said interior of said canister and said intake system, the improvement comprising:

a two-way valve arranged in said vent passage and disposed to open both when pressure within said fuel tank exceeds a first predetermined pressure value higher than atmospheric pressure and when said pressure within said fuel tank is below a second predetermined pressure value lower than the atmospheric pressure;

a pressure valve arranged in said vent passage in parallel with said two-way valve and disposed to open when said pressure within said fuel tank exceeds a third predetermined pressure value lower than said first predetermined pressure value; and an electromagnetic valve arranged in said vent passage in series with said pressure valve.

2. An evaporative fuel processing control system as claimed in claim 1, wherein a second electromagnetic valve is arranged in said vent passage in parallel with said pressure valve.

3. In an evaporative fuel processing control system for an internal combustion engine having a fuel tank, including a canister, a vent passage communicating between an upper space within said fuel tank and an interior of said canister, and a valve arranged in said vent passage for opening and closing said vent passage, the improvement comprising:

fuel surface level-detecting means for detecting a surface level of fuel within said fuel tank; and valve control means for opening said valve when said engine is in a predetermined operating condition, and for closing said valve when it is detected by said fuel surface level-detecting means that said surface level of fuel within said fuel tank is above a predetermined surface level.

4. An evaporative fuel processing control system as claimed in claim 3, wherein said valve control means closes said valve when a speed of vehicle in which said engine is installed has been continuously below a predetermined value over a predetermined time period.

5. In an evaporative fuel processing control system for an internal combustion engine having a fuel tank, including a canister, a vent passage communicating between an upper space within said fuel tank and an interior of said canister, a two-way valve arranged in said vent passage and disposed to open both when pressure within said fuel tank exceeds a first predetermined valve-opening positive pressure value higher than atmospheric pressure and when said pressure within said fuel tank is below a predetermined valve-opening negative pressure value which is lower than the atmospheric pressure, and an electromagnetic valve arranged in parallel with said two-way valve, the improvement comprising:

fuel surface level-detecting means for detecting a surface level of fuel within said fuel tank; and electromagnetic valve control means for opening said electromagnetic valve when said engine is in a predetermined operating condition, and for closing said electromagnetic valve when it is detected by said fuel surface level-detecting means that said surface level of fuel within said fuel tank is above a predetermined surface level.

6. An evaporative fuel processing control system as claimed in claim 5, further including a pressure valve arranged in series with said electromagnetic valve and disposed to open when said pressure within said fuel tank exceeds a predetermined valve-opening positive pressure value lower than said first predetermined valve-opening positive pressure value.

7. An evaporative fuel processing control system as claimed in claim 6, wherein said electromagnetic valve control means closes said electromagnetic valve when a speed of a vehicle in which said engine is installed has been continuously below a predetermined value over a predetermined time period.

8. In an evaporative fuel processing control system for an internal combustion engine having a fuel tank, including a canister, a vent passage communicating between an upper space within said fuel tank and an interior of said canister, and a valve arranged in said vent passage for opening and closing said vent passage, the improvement comprising:

operation-stoppage-detecting means for detecting whether said engine is in an operative state or in stoppage state; and valve control means for holding said valve in an open state if said valve is in said open state when it is detected by said operation-stoppage-detecting means that said engine has shifted from said operative state into said stoppage state, and for immediately closing said valve when said engine is restarted within a predetermined time period after said engine shifted into said stoppage state, or for closing said valve upon the lapse of said predetermined time period after said engine shifted into said stoppage state when said engine is not restarted within said predetermined time period.

9. In an evaporative fuel processing control system for an internal combustion engine having a fuel tank, including a canister, a vent passage communicating between an upper space within said fuel tank and an interior of said canister, and a valve arranged in said vent passage for opening and closing said vent passage, the improvement comprising:

operation-stoppage-detecting means for detecting whether said engine is in an operative state or in stoppage state;

fuel surface level-detecting means for detecting a surface level of fuel within said fuel tank; and valve control means for holding said valve in an open state if said valve is in said open state when it is detected by said operation-stoppage-detecting means that said engine has shifted from said operative state into said stoppage state, and for immediately closing said valve when it is detected by said fuel surface level-detecting means that said surface level of fuel within said fuel tank is equal to or higher than a predetermined level, within a predetermined time period after said engine shifted into said stoppage state, or for closing said valve upon the lapse of said predetermined time period after said engine shifted into said stoppage state when said surface level of fuel within said tank does not reach said predetermined level within said predetermined time period.

10. An evaporative fuel processing control system as claimed in claim 5, wherein said electromagnetic valve control means closes said electromagnetic valve when a speed of a vehicle in which said engine is installed has been continuously below a predetermined value over a predetermined time period.

* * * * *